United States Patent [19]

van Raalte

[11] 4,137,485

[45] Jan. 30, 1979

[54] IMAGE DISPLAY BLOCK SCANNING METHOD

[75] Inventor: John A. van Raalte, Princeton, N.J.

[73] Assignee: RCA Corporation, New York, N.Y.

[21] Appl. No.: 783,654

[22] Filed: Apr. 1, 1977

[51] Int. Cl.[2] ..... H01J 29/70; H01J 29/72

[52] U.S. Cl. ..... 315/366; 313/422

[58] Field of Search ..... 315/366; 313/422

[56] References Cited

U.S. PATENT DOCUMENTS

| | | | |
|---|---|---|---|
| 2,899,597 | 8/1959 | Kompfner | 315/382 |
| 2,930,930 | 3/1960 | Aiken | 313/422 |
| 3,181,027 | 4/1965 | Geer | 313/422 |
| 4,031,427 | 6/1977 | Stanley | 315/366 |

*Primary Examiner*—Theodore M. Blum

*Attorney, Agent, or Firm*—E. M. Whitacre; G. H. Bruestle; G. E. Haas

[57] ABSTRACT

An image display device has a plurality of electron guides for guiding electron beams to different areas of the device's cathodoluminescent screen. An image is displayed on a device by generating a plurality of electron beams and modulating each of the electron beams with the image information. The beams are directed into one group of a plurality of adjacent electron beam guides so that each beam is directed into a separate guide. The electron beams are then sequentially switched into the next group of adjacent guides until each electron guide has had one beam directed into it.

8 Claims, 4 Drawing Figures

IMAGE DISPLAY BLOCK SCANNING METHOD

BACKGROUND OF THE INVENTION

The present invention relates to cathodoluminescent flat display devices and specifically to a method for scanning such devices which employ a plurality of electron beam guides.

Recently, flat image display devices have been suggested having a viewing screen of about 75 × 100 cm. and a total depth of about 2.7 to 10.0 cm. One such device is described in U.S. patent application Ser. No. 607,492 entitled "Flat Electron Beam Addressed Device" filed on Aug. 25, 1975 by T. O. Stanley now U.S. Pat. No. 4,031,427. This type of device utilizes a plurality of electron beams which excite different portions of a large phosphor screen. A plurality of electron beam guides extends between the front and rear surfaces of the device to direct the electron beams to the proper area of the screen. In the original system, a separate electron beam guide was used for each picture element and each guide had a separate source for generating its own electron beam.

Conventional electron guns require excessive amounts of space and power to be practical in such systems. An alternate proposal has been to utilize a smaller number of electron guns and sequentially direct the beam from each gun into each of the beam guides during every line time so that, one at a time, each electron beam scans each electron beam guide. Although the latter system has considerable merit, in order to display a television image, the switching of the electron beams from one guide to another must occur at relatively high speed, e.g., 10 MHz. in order for each beam to go into each guide. The high switching speed necessitates rather complex and expensive control circuitry.

SUMMARY OF THE INVENTION

A flat image display device employs a plurality of electron beam guides to direct electron beams to various portions of a cathodoluminescent screen. An image is displayed on the screen by generating a plurality of electron beams which are then modulated by the image information. The modulated beams are directed into different electron guides in one group and then onto the screen where they excite the cathodoluminescent elements to display various picture elements. Next, the electron beams are successively switched into the other groups of electron beam guides until each beam guide of the display has received one of the electron beams.

DETAILED DESCRIPTION OF THE PREFERRED EMBODIMENT

Figure 1:
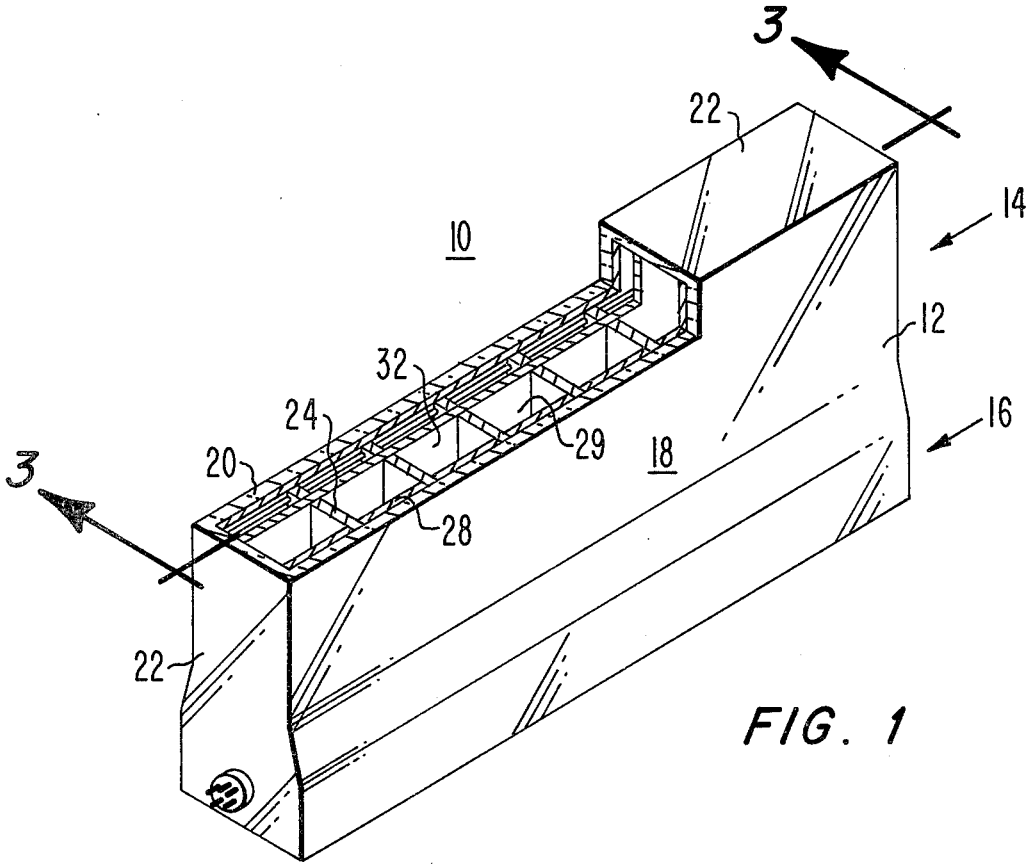
FIG. 1 is a cut-away perspective view of a flat image display device for use with the present inventive method.

Referring to FIG. 1, one form of a flat display of the present invention is generally designated as 10. The display device 10 comprises an evacuated envelope 12 typically of glass, having a display section 14 and an electron gun section 16. The envelope 12 includes a rectangular front wall 18 and a rectangular back wall 20 in spaced parallel relation with one another connected by sidewalls 22.

A plurality of spaced, parallel, support walls 24 are secured between the front wall 18 and the back wall 20 in the display section 14. The support walls 24 provide the desired internal support for the evacuated envelope 12 against external atmospheric pressure and divide the display section 14 into a plurality of channels 29. The channels extend in the vertical dimension when the device 10 is oriented as shown in the drawings. On the inner surface of the front wall 18 is a screen 28 composed of cathodoluminescent elements which may be of any well known type presently used in cathode ray tubes.

Figure 2:
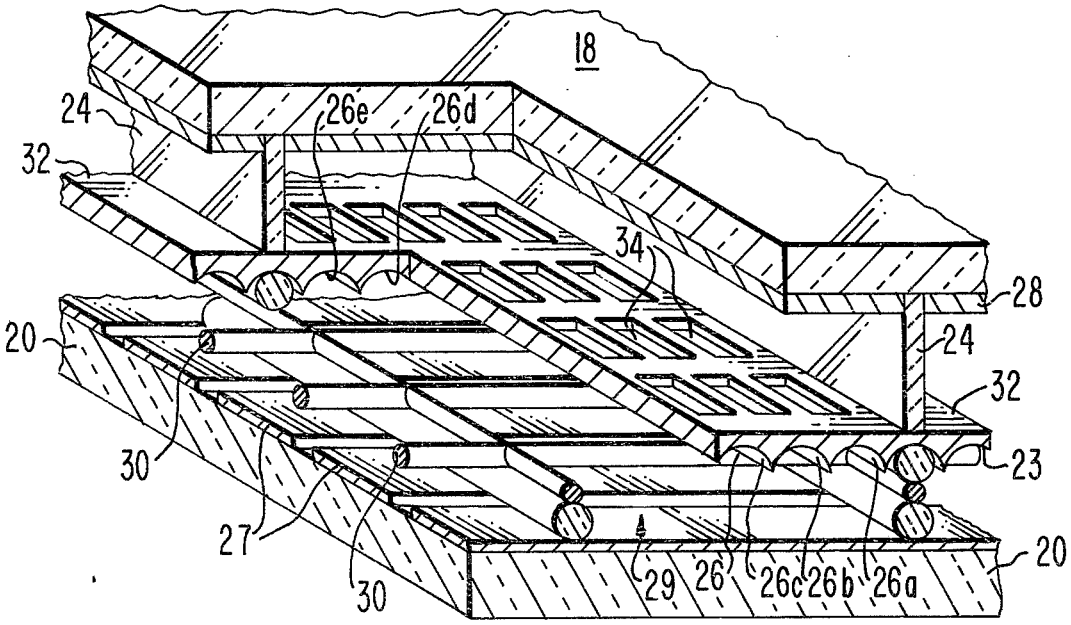
FIG. 2 is a transverse sectional view looking down on the cut-away portion of FIG. 1.

As shown in FIG. 2, within each of the channels 29 are five vertical electron beam guides 26*a* through *e*. Each beam guide 26 utilizes the technique of slalom focussing which is described in the article entitled, "Slalom Focussing", by J. S. Cook et al., *Proceedings of the IRE*, Vol. 45, November 1957 pages 1517–1522. Slalom focussing as there described, makes use of an electron guide formed by a plurality of spaced parallel wires or rods arranged in a common plane midway between two parallel plates. The wires or rods are charged positively with respect to the plates. The electrostatic field thereby created is such that when the beam of electrons is directed into the space between the plates along the plane of the rods or wires, the beam will weave in an undulating path through the array of rods or wires.

The vertical beam guides 26 in the present device comprise a plurality of electrode stripes 27 extending transversely across all the channels 29 on the back wall 20. Spaced from and substantially parallel to the back wall 20 are a plurality of conductors 30 such as wires extending across all the channels 29. Between the conductors 30 and the front wall 18 is a metal ground plate 32 which extends transversely across all of the channels 29 substantially parallel to the back wall 20. The back side of the ground plate has a plurality of grooves 23 which help define the vertical guides 26. The electrode stripes 27 and the ground plate 32 form the ground potential planes for confining each electron beam as it travels through the electron beam guide oscillating above and below the conductors 30. By properly biasing the electrode stripes on the back wall with repelling voltages, the electron beams may be deflected toward the screen through apertures 34 in the ground plate 32. The electron beams then strike the screen 28 exciting the cathodoluminescent elements. A transition electrode stripe 25 extends across the ends of the vertical guides 26 which are closest to the gun section 16 as shown in FIG. 3.

Figure 3:
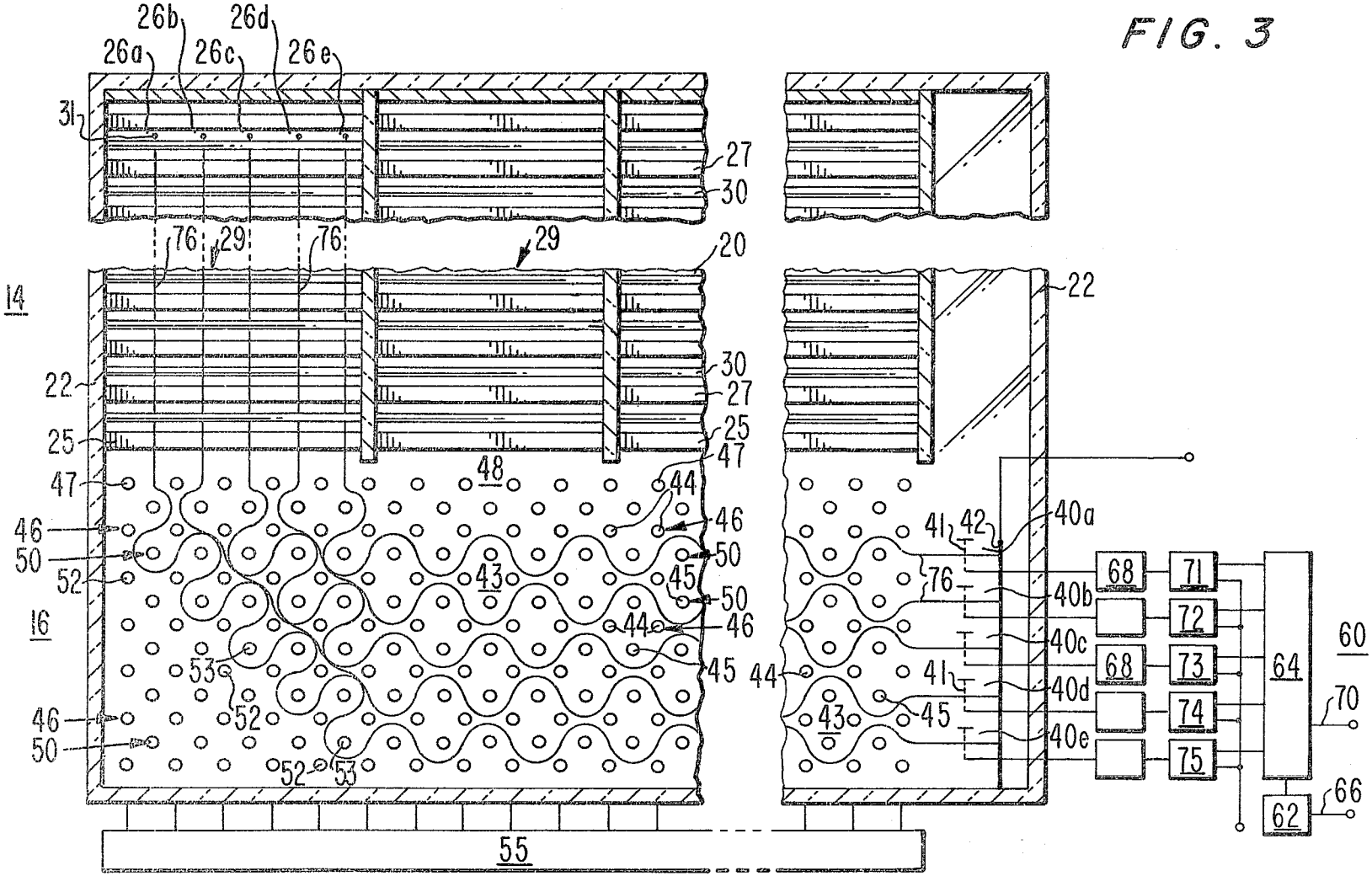
FIG. 3 is a sectional view along line 3—3 of FIG. 1 showing one step in the present method.

The gun section 16 is an extension of the display section 14 and extends along one set of adjacent ends of the channels 29 as shown in FIG. 3. At one end of the gun section are five electron guns 40*a–e* which utilize a single line cathode 42 and individual modulation grids 41. The number of guns in the drawing is meant purely for illustrative purposes and may vary depending upon the size of the display.

Each electron gun is associated with a different horizontal slalom beam guide 43 and injects an electron beam 76 into the guide. The horizontal guides 43 comprise a plurality of first electrodes 44 extending between the front and back walls 18 and 20 in the gun section and arranged in substantially parallel rows. The distance between the electrodes 44 in each row is equal to the width of a vertical guide 26. The horizontal guides 43 also comprise a plurality of second electrodes 45 arranged in rows alternating with the rows of first electrodes 44. The second electrodes 45 are staggered with respect to the first electrodes 44. The rows of first electrodes 44 form ground planes on each side of each row of positively biased second electrodes 45. The second electrodes 45 are positively biased so that the electron beams 76 will oscillate above and below the second electrodes 45. A transition horizontal guide 48 is between the other horizontal guides 43 and the display section 14 and does not have an electron gun associated with it. The electrodes 47 nearest the display section in the transition guide 48 are transition electrodes for guiding the beam 76 into the vertical guides 26.

The electron guns 40*a–e* are controlled separately by a gun modulation control circuit 60 comprising an analog to digital (A/D) converter 62, a shift register 64, five sample and hold circuits 71–75 and five digital to analog (D/A) converters 68. The video input line 66 is connected to the input of the A/D converter 62. The output from the A/D converter is fed to the shift register 64. The shift register 64 is a serial in-parallel out type with one stage for each gun 40*a–e*. A separate sample and hold circuit 71–75 is connected to each parallel output from the shift register 64. The output of each sample and hold circuit 71–75 goes to a D/A converter 68 with its output connected to one of the gun modulation grids 41.

During the operation of the device, an incoming sequential video signal, such as the NTSC signal, on line 66 is sampled and digitized by the A/D converter 62 and fed to the shift register 64. When the shift register is full, a pulse on clock line 70 transfers the video signal for each gun 40*a–e* contained in the shift register 64 to the sample and hold circuits 71–75. The output of the sample and hold circuits is converted back to analog by five D/A converters 68 and is used to bias the control grid 41 of each of the electron guns 40 A/D. The line cathode 42 is then biased to emit electrons and the emitted electron beams 68 are modulated by the output of the D/A converters 76.

Each of the electron beams 76 travels through its corresponding horizontal beam guide 43 confined to the horizontal beam guide by the ground planes formed by the first electrodes 44. As the electron beam 76 travels through the horizontal guide 43, it weaves above and below the positively biased second electrodes 45. This concept of using a set of positively biased electrodes between two confining ground planes as a beam guide is described generally in U.S. Pat. No. 2,899,597, entitled "Apparatus Using Slalom Focusing" issued on Aug. 11, 1959 to R. Kampfner.

Each of the electron beams is then deflected out of the horizontal beam guide 43 and into one of the vertical beam guides 26. When one of the beams 76 is to be deflected into a vertical guide 26 of a channel 29, the next electrode 52 in the first row 46 which is more remote from the display section 14 in the particular guide is switched to a negative potential causing the electron beam to curl around the previously positive biased electrode 53 in the second row 50. The electron beam 76 then takes a weaving path at right angles to the previous path toward one of the vertical guides 26 in a channel 29. The beam continues in a vertical direction to weave around the positively biased second electrodes 45 confined horizontally by the first electrodes 44. The transition electrodes 47 are biased so as to straighten out the beam and align it with a vertical guide 26.

The electron beam from the first gun 40*a* is directed into the first vertical guide 26*a*. The electron beam from a second electron gun 40*b* is simultaneously directed into the second vertical guide 26*b* and so on until each of the beams from the five guns is directed into one of the five vertical guides 26*a–e* in the first channel 29. Once each beam 76 reaches the channel 29, it begins to weave above and below the conductors 30 in the vertical beam guide 26. The transition stripe 25 deflects the beam 76 above or below the first conductor 30 as may be necessary to achieve the proper slalom path for later deflection toward the screen. The beams continue in the vertical guide 26 until they are deflected toward the Phosphor screen 28 at a point designated 31 in FIG. 3. The deflection is accomplished by biasing one of the electrode stripes 27 on the back wall 20 to repel each beam through the openings 34 in the ground plate 32. When a beam strikes the screen 28, a cathodoluminescent element is excited thereby emitting light. The five beams strike the screen along a horizontal line so as to display a section of the display line of the image.

Figure 4:
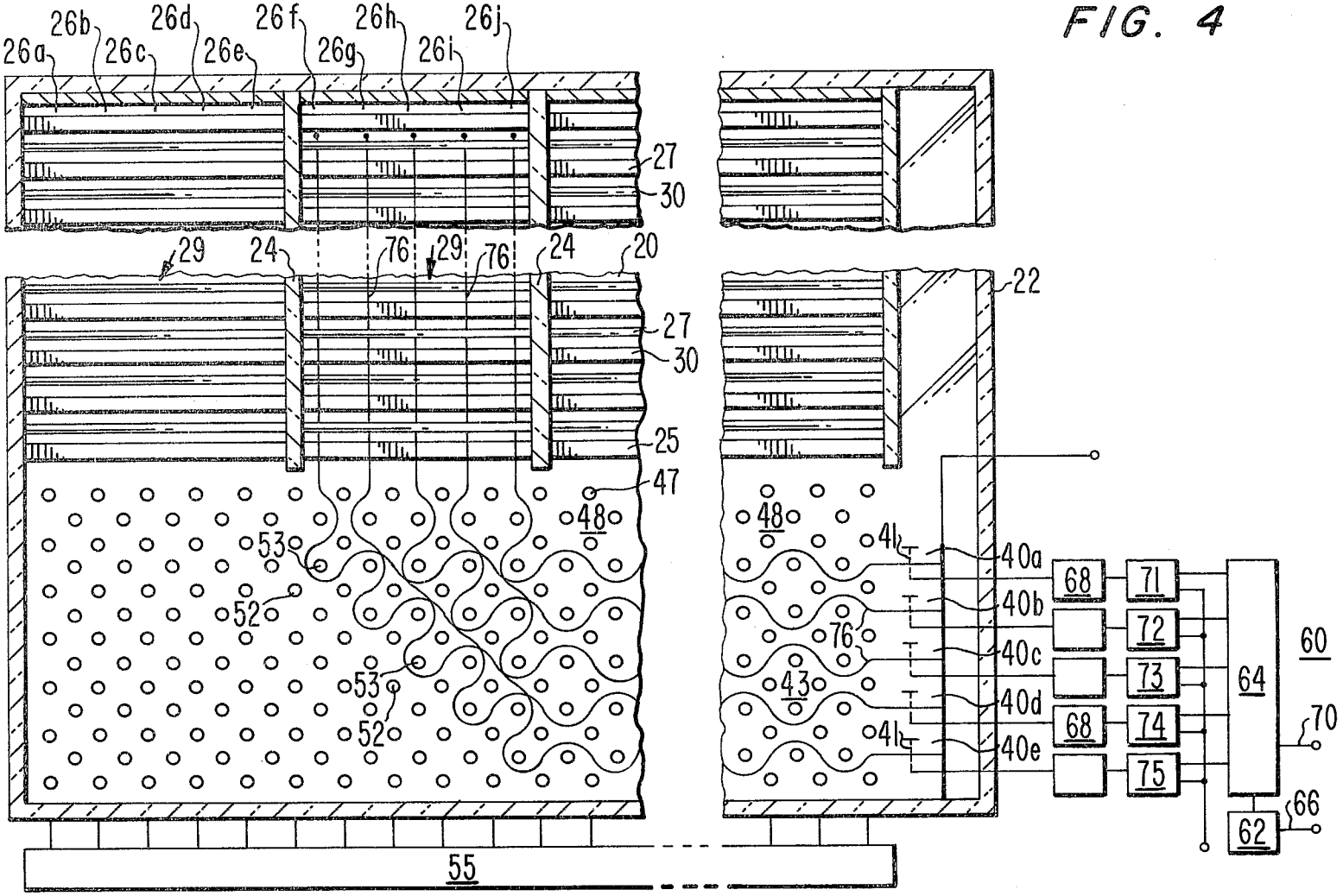
FIG. 4 is a sectional view similar to that of FIG. 3 but at a later instant in time in the present method.

During the on time of the beams, the sample and hold circuits 71–75 maintain the bias on the grids 41 even though the incoming sampled video signal continues to be fed on line 66 through the A/D converter 62 to the shift register 64. When the video information for the 10th picture element has been fed into the shift register 64, the five beams are turned off and the new contents of the shift register 64 are transferred out while the sample and hold circuits 71–75 are clocked to store the new video information for the next five picture elements. At the same time the deflection points from the horizontal beam guides 43 into the vertical beam guides 26 are switched to deflect each of the five beams into the next set of five vertical beam guides 26*f–j* as shown in FIG. 4. This deflection switching is accomplished by changing the bias on a new set of deflection electrodes 52 by means of control circuit 55. The electron guns 40*a–e* are then turned on and the sample and hold circuits bias the grids 41, to display the next set of five picture elements along the horizontal line of the screen 28. The beams are then deflected into the next set of five beam guides 26*f–j* and toward the screen to display the next segment of the horizontal display line on the screen. The clocking of the sample and hold circuits 71–75 and the switching of the deflection points continue in blocks of five until all of the cathodoluminescent elements along the selected line have been excited by an electron beam 76. When this occurs a new line to be scanned is selected by biasing another electrode stripe 27 so as to deflect the electron beams to the next horizontal line on the screen. The scanning of the other lines in the image continues by repeating the process described above until all the image lines have been scanned.

By deflecting each electron beam only into every fifth vertical beam guide, the speed at which the biasing voltage must be switched from one deflection electrode to the next deflection electrode as well as the speed at which cathode modulation is updated, have been greatly reduced, resulting in a simplification in circuitry. As noted previously, five guns were chosen for the description herein purely for illustration purposes and are not necessarily representative of the optimum number of guns and beams which can be employed in display devices. The optimum number is dependent upon a number of factors including the total number of cathodoluminescent elements in each display line and the trade-off in circuit speed versus the number of switching points to be controlled by the circuit. For a television display device utilizing approximately 640 cathodoluminescent elements of each color in each horizontal line, between 10 and 40 electron guns and beams are believed to be optimum. Also, the number of vertical electron guides within each channel 29 need not be the same as the number of guns 40 and the horizontal guides 43 as in the example above.

A number of permutations to the above specific embodiment can evolve based on this block scanning concept. The scanning can be interlaced wherein the beams are not directed simultaneously into adjacent vertical guides. Under this variation, the five beams are simultaneously directed into every $M^{th}$ vertical guide where $M = X/Y$, $X$ being the total number of vertical guides and $Y$ being the number of electron guns. The Y beams are then simultaneously directed into the next adjacent group of every $M^{th}$ vertical guides. The beams are successively directed into other groups of every $M^{th}$ guides until an electron beam has been directed into every vertical guide. In a variation of this interlace method, the vertical guides X are divided into N blocks of P guides so that $X = NP$. Under this scheme, $M = P/Y$ and the P vertical guides in one block are interlaced scanned as described above. After the one block is scanned, the other blocks are scanned in succession.

In another variation the scan stepping can overlap the beam paths from one deflection point to another. Rather than stepping from the first group of five vertical guides to the second group of five guides, as in the scheme presented in FIGS. 3 and 4, the five beams may be stepped less than five guides at a time. A better example of this variation is in a device utilizing an even number of guns and beams, say six. In this case, the beams would step three vertical guides at a time so that the scanning overlaps and each vertical guide receives two different electron beams. This variation improves the brightness uniformity of the display by averaging non-uniformities in individual beam intensities.

I claim:

1. A method for scanning a line of an image in a display device having a cathodoluminescent screen and X number of first electron beam guides each of which periodically confines an electron beam as it travels along the guide, said guides being divided into groups, each of which consists of Y number of guides, said method comprising the steps of:

generating Y number of electron beams;

modulating each of said electron beams with image information;

sequentially directing said electron beams into each group of first beam guides so that each beam is directed into only one guide in each group; and deflecting each beam out of the first beam guides and toward the cathodoluminescent screen.

2. The method as in claim 1 wherein said method further includes Y number of second beam guides and the sequentially directing step comprises:

guiding each beam in a separate second beam guide;

deflecting each beam out of the second beam guide into a different first beam guide in one group; and switching the deflection so that the beams are successively directed into each group of first guides.

3. The method as in claim 2, wherein the first guides of each group are adjacent to one another.

4. The method as in claim 2, wherein said groups are interleaved such that each guide in a group of first guides is spaced X/Y guides apart.

5. The method as in claim 1, including reprocessing the conventional sequential video signal so that it may be used to simultaneously modulate the electron beams.

6. A method for scanning a line of an image in a display device having a cathodoluminescent screen and X number of first electron beam guides each of which periodically confines an electron beam as it travels along the guide, said guides being divided into a plurality of blocks each of which has P number of first guides and which is divided into groups of Y number of first guides; said method comprising the steps of:

scanning the first guides in one block by generating Y number of electron beams; sequentially directing the electron beams into each group of first beam guides so that each beam is directed into only one guide in each group; and deflecting each beam out of the first beam guide and toward the cathodoluminescent screen; and then successively scanning each of the remaining blocks one at a time in the same manner as the one block.

7. The method as in claim 6, wherein the first guides of each group are adjacent to one another, the device further includes Y number of second beam guides, and the step of sequentially directing the beams comprises:

guiding each beam in a separate second beam guide;

deflecting each beam out of the second beam guide into a different first beam guide in one group; and switching the deflecting so that the beams are successively directed into successive groups of first guides in one block.

8. The method as in claim 6, wherein the groups within each block are interleaved with each other such that each first guide in a group is spaced P/Y guides apart and the step of sequentially directing the electron beams comprises:

guiding each beam in a separate second beam guide;

deflecting each beam out of the second beam guide into a different first beam guide in one group; and switching the deflection so that the beams are successively directed into all the first guides in said one block.

* * * * *

UNITED STATES PATENT AND TRADEMARK OFFICE
CERTIFICATE OF CORRECTION

PATENT NO. : 4,137,485

DATED : January 30, 1979

INVENTOR(S) : John A van Raalte

It is certified that error appears in the above-identified patent and that said Letters Patent is hereby corrected as shown below:

Column 3, line 42: "68" should be --76--.

Column 3, line 43: "76" should be --68--.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*